US007221099B2

(12) United States Patent
Jeon et al.

(10) Patent No.: US 7,221,099 B2
(45) Date of Patent: May 22, 2007

(54) ELECTRON EMISSION DEVICE AND DRIVING METHOD THEREOF

(75) Inventors: Sang-Ho Jeon, Suwon-si (KR); Chun-Gyoo Lee, Suwon-si (KR); Sang-Jo Lee, Suwon-si (KR); Sang-Hyuck Ahn, Suwon-si (KR); Su-Bong Hong, Suwon-si (KR)

(73) Assignee: Samsung ASDI Co., Ltd., Suwon-si (KR)

( * ) Notice: Subject to any disclaimer, the term of this patent is extended or adjusted under 35 U.S.C. 154(b) by 0 days.

(21) Appl. No.: 11/351,632

(22) Filed: Feb. 9, 2006

(65) Prior Publication Data

US 2007/0001615 A1 Jan. 4, 2007

(30) Foreign Application Priority Data

Jun. 29, 2005 (KR) ..... 10-2005-0056825

(51) Int. Cl.
*G09G 3/10* (2006.01)

(52) U.S. Cl. ..... 315/169.1; 313/495; 345/76

(58) Field of Classification Search ..... 315/169.1, 315/169.3, 169.4; 313/495, 496, 497, 498; 345/76, 60

See application file for complete search history.

(56) References Cited

U.S. PATENT DOCUMENTS 6,346,776 B1 2/2002 Robinson et al. ..... 345/169.3
6,495,965 B1 * 12/2002 Yamaura et al. ..... 315/167
6,617,798 B2 * 9/2003 Lee et al. ..... 315/169.3
6,621,232 B2 * 9/2003 Jo et al. ..... 315/169.3
2001/0043172 A1 11/2001 McGrath et al. ..... 315/169.3

OTHER PUBLICATIONS

European Search Report dated Aug. 29, 2006, for EP 06116040.4, in the name of Samsung SDI Co., Ltd.

* cited by examiner

*Primary Examiner*—Thuy V. Tran
*Assistant Examiner*—Jimmy Vu
(74) *Attorney, Agent, or Firm*—Christie, Parker & Hale, LLP

(57) ABSTRACT

An electron emission device and a method of driving the electron emission device are capable of preventing the deterioration of luminance in displaying moving images by inhibiting the emission delay. The electron emission device includes cathode electrodes, gate electrodes formed over the cathode electrodes, and an insulating layer disposed between the cathode electrodes and the gate electrodes. Electron emission regions are formed on the cathode electrodes to emit electrons under the application of electric fields generated due to a difference between voltages applied to the cathode electrodes and the gate electrodes. A driving unit applies voltages to the cathode electrodes and the gate electrodes. An anode electrode receives a positive voltage to accelerate the electrons emitted from the electron emission regions. A first voltage Vc applied to the cathode electrodes and a second voltage Vg applied to the gate electrodes satisfy the following condition: $0.4 \leqq Vc/Vg < 0.8$.

13 Claims, 6 Drawing Sheets

ELECTRON EMISSION DEVICE AND DRIVING METHOD THEREOF

CROSS REFERENCE TO RELATED APPLICATION

This application claims priority to and the benefit of Korean Patent Application No. 10-2005-0056825 filed on Jun. 29, 2005 in the Korean Intellectual Property Office, the entire content of which is incorporated herein by reference.

BACKGROUND OF THE INVENTION

1. Field of the Invention

The present invention relates to an electron emission device, and in particular, to an electron emission device which prevents the luminance from being varied when displaying moving images by inhibiting the delay of emission.

2. Description of Related Art

Generally, electron emission devices are classified into those using hot cathodes as an electron emission source, and those using cold cathodes as the electron emission source. There are several types of cold cathode electron emission devices, including a field emitter array (FEA) type, a metal-insulator-metal (MIM) type, a metal-insulator-semiconductor (MIS) type, and a surface conduction emitter (SCE) type.

The FEA type of electron emission device is based on the principle that when a material having a low work function or a high aspect ratio is used as an electron emission source, electrons are easily emitted from the material due to the electric field in a vacuum atmosphere. A sharp-pointed tip structure based on molybdenum (Mo) or silicon (Si), or a carbonaceous material, such as carbon nanotube, graphite and diamond-like carbon, has been developed to be used as electron emission regions.

In common FEA type electron emission devices, cathode electrodes, an insulating layer and gate electrodes are sequentially formed on a first substrate, and openings are formed at the gate electrodes and the insulating layer. Electron emission regions are formed on the cathode electrodes within the openings. Phosphor layers and an anode electrode are formed on a surface of a second substrate facing the first substrate.

The cathode electrodes supply the electric current required for emitting electrons to the electron emission regions, and the gate electrodes control the electron emission using the voltage difference thereof from the cathode electrodes. The anode electrode receives a direct current (DC) voltage of several hundred to several thousand volts, and keeps the phosphor layers in a high potential state, thereby effectively accelerating the electrons emitted from the electron emission regions toward the phosphor layers.

Commonly, the gate electrodes are used as scan electrodes, and the cathode electrodes are used as data electrodes for carrying the image data.

Scan pulses are sequentially applied to the gate electrodes, and data pulses are selectively applied to the cathode electrodes corresponding to the gate electrodes receiving the scan pulses. Electric fields are formed around the electron emission regions at the pixels where the voltage difference between the two electrodes exceeds a threshold value, and electrons are emitted from the electron emission regions. The emitted electrons are attracted by the high voltage applied to the anode electrode, and collide against the corresponding phosphor layers, thereby light-emitting them.

With common electron emission devices, when the presence and the amount of electron emission are quickly and correctly controlled in accordance with the driving signals applied to the cathode and the gate electrodes, accurate displaying in accordance with image signals can be accomplished. The amount of electron emission is observed by the emission current reaching the anode electrode. The amount of electron emission and the emission current will hereinafter be used interchangeably.

The above problem can be exacerbated when the electron emission device displays moving images or the images are shifted while inducing considerably large-scaled variation in the emission current. For instance, when the images are shifted from the black mode to the white mode, the emission current should be quickly recovered in accordance with the driving signals. Otherwise, the luminance is deteriorated at the initial section of the white mode.

Rectangular wave pulses are typically applied to the cathode and the gate electrodes. The rectangular wave pulses involve relatively high voltages, and the larger the number of pixels involved, the shorter the application period of the ON time becomes. A signal distortion may result from a delay in the driving signals due to the parasitic capacitance generated at the crossed regions of the cathode and the gate electrodes, or from the internal resistance of the cathode and the gate electrodes. The delay of the driving signals results in an emission delay, and deteriorates the display quality.

SUMMARY OF THE INVENTION

In one exemplary embodiment of the present invention, an electron emission device inhibits the emission delay to reduce or minimize the luminance deterioration in displaying moving images and enhances the display quality. Another exemplary embodiment relates to a method of driving the electron emission device.

In one exemplary embodiment of the present invention, an electron emission device includes cathode electrodes, gate electrodes formed over the cathode electrodes, and an insulating layer disposed between the cathode electrodes and the gate electrodes. Electron emission regions are formed on the cathode electrodes to emit electrons under the application of the electric fields generated due to the difference between the voltages applied to the cathode electrodes and the gate electrodes. A driving unit applies voltages to the cathode and the gate electrodes. An anode electrode receives a positive voltage to accelerate the electrons emitted from the electron emission regions. The first voltage Vc applied to the cathode electrodes and the second voltage Vg applied to the gate electrodes satisfy the following condition: $0.4 \leqq Vc/Vg < 0.8$.

The driving unit respectively applies the first voltage and the second voltage to the cathode electrodes and the gate electrodes such that electrons are not emitted from the electron emission regions.

The driving unit applies pulses with the first voltage and a third voltage lower than the first voltage to the cathode electrodes while applying the second voltage to the gate electrode. The amount of electrons emitted from the electron emission regions is determined by the period of time during which the third voltage is applied to the cathode electrodes.

A focusing electrode is further formed over the gate electrodes to receive 0V or a negative voltage.

A method of driving an electron emission device is used with first electrodes, second electrodes insulated from the first electrodes, and electron emission regions formed on any one of the first and the second electrodes to emit electrons due to a difference between the voltages applied to the first and the second electrodes. A first voltage is applied to the first electrodes. Pulses with a second voltage and a third voltage are applied to the second electrodes while applying the first voltage to the first electrodes. The first voltage and the second voltage satisfy the condition of $0.4 \leqq Vc/Vg < 0.8$, where Vc indicates a lower one of the first and the second voltages, and Vg indicates a higher one of the first and the second voltages.

When the third voltage is applied to the second electrodes, electrons are emitted from the electron emission regions.

In one embodiment, the electron emission regions are formed at the second electrodes, Vc is the second voltage, and Vg being the first voltage.

An amount of electrons emitted from the electron emission regions may also be determined by the period of time during which the third voltage is applied.

DETAILED DESCRIPTION

Figure 1:
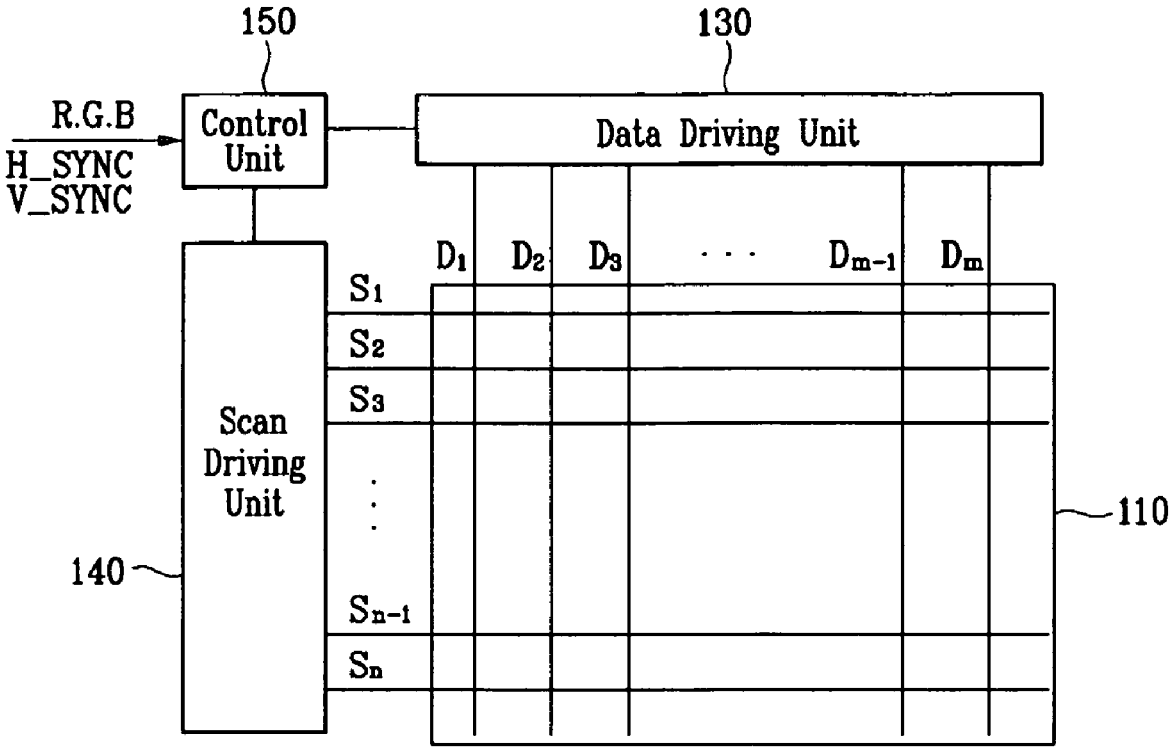
FIG. 1 is a schematic view of an electron emission device according to an embodiment of the present invention.

As shown in FIG. 1, an electron emission device includes a display panel 110, a scan driving unit 140 for driving scan electrodes $S_1$–Sn, a data driving unit 130 for driving data electrodes $D_1$–Dm, and a control unit 150 for controlling the scan and the data driving units 140 and 130.

The display panel 110 has n scan electrodes $S_1$–Sn, and m data electrodes $D_1$–Dm, and electron emission regions are provided at the respective crossed regions of the scan and the data electrodes $S_1$–Sn and $D_1$–Dm.

The control unit 150 receives image signals R, G and B, vertical synchronization signals V-SYNC and horizontal synchronization signals H-SYNC, and generates scan and data driving signals. The control unit 150 then applies those signals to the scan and the data driving units 140 and 130. The scan driving unit 140 applies scan driving voltages to the scan electrodes $S_1$–Sn based on the input scan driving signals, and the data driving unit 130 applies data driving voltages to the data electrodes $D_1$–Dm based on the input data driving signals.

Figure 2:
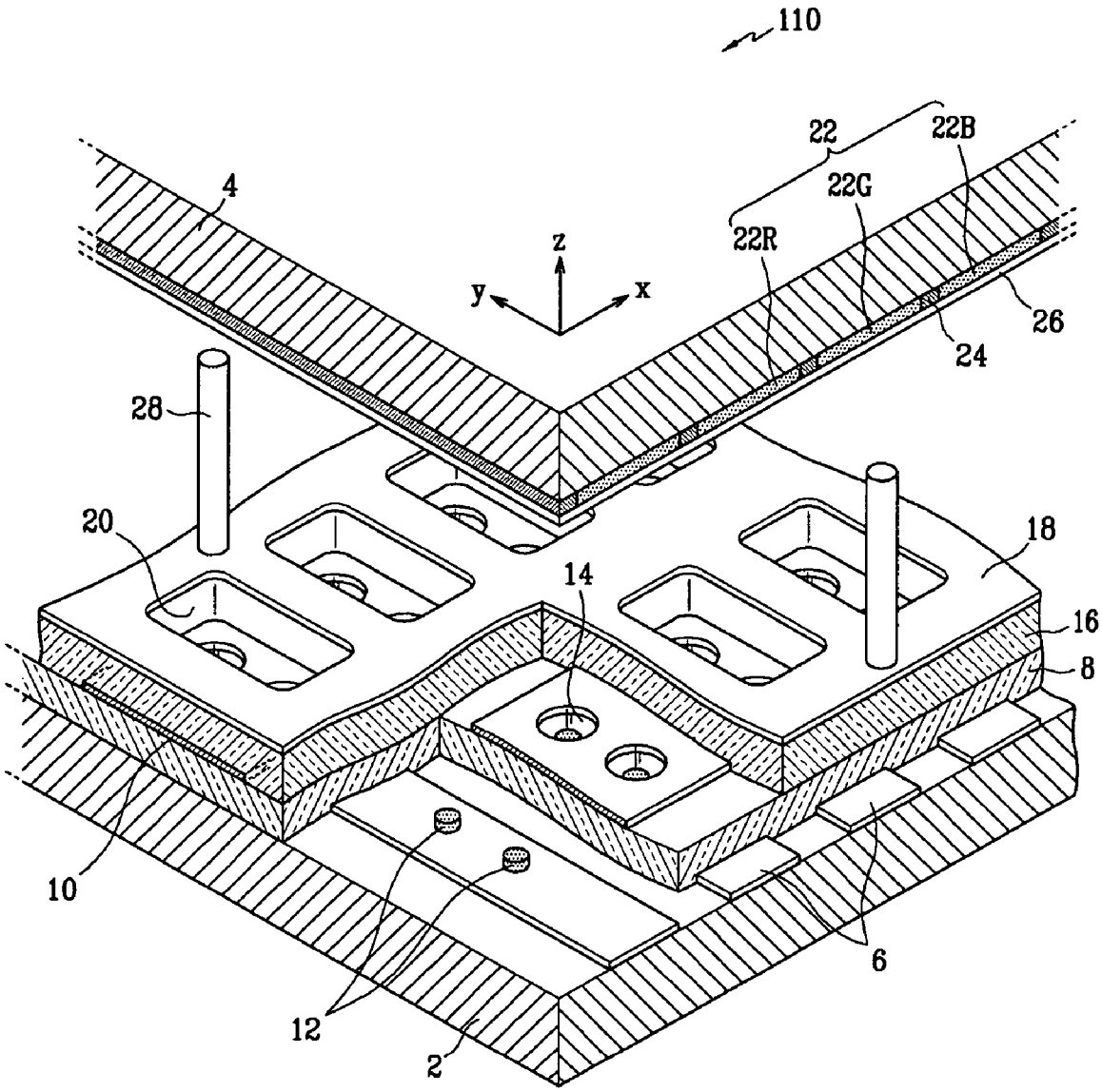
FIG. 2 is a partial exploded perspective view of a display panel for the electron emission device according to an embodiment of the present invention.
Figure 3:
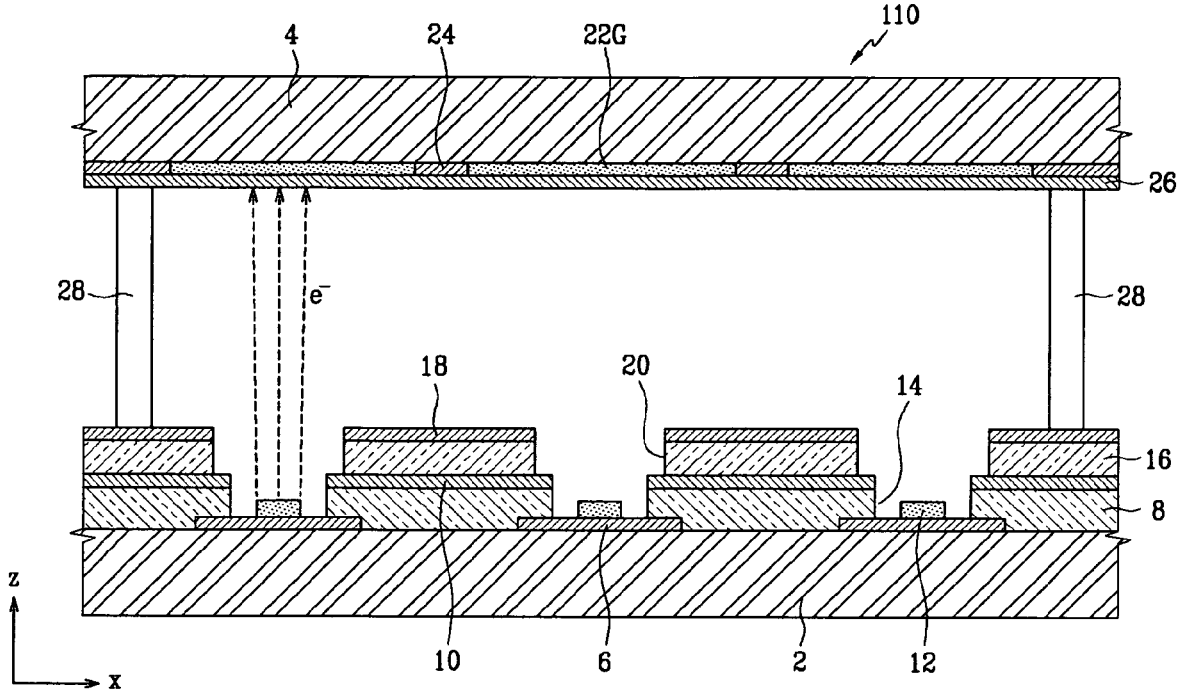
FIG. 3 is a partial sectional view of a display panel according to an embodiment of the present invention.

As shown in FIGS. 2 and 3, the display panel 110 includes first and second substrates 2 and 4 arranged parallel to each other and spaced apart from each other at a predetermined distance. An electron emission structure is provided at the first substrate 2, and a light emission structure is provided at the second substrate 4 to emit visible rays and display the desired images.

Cathode electrodes 6 are stripe-patterned on the first substrate 2 in a first direction, and a first insulating layer 8 is formed on and covers substantially the entire area of the first substrate 2. The first insulating layer 8 also covers the cathode electrodes 6. Gate electrodes 10 are stripe-patterned on the first insulating layer 8 perpendicular to the first direction.

The crossed regions of the cathode and the gate electrodes 6 and 10 form unit pixels, and one or more electron emission regions 12 are formed on the cathode electrodes 6 per the respective unit pixels. Openings 14 are formed at the first insulating layer 8 and the gate electrodes 10 corresponding to the respective electron emission regions 12 while exposing the electron emission regions 12 on the cathode electrodes 6 patterned on the first substrate 2.

The electron emission regions 12 are formed with a material emitting electrons when an electric field is applied under a vacuum atmosphere, such as a carbonaceous material or a nanometer-sized material. The electron emission regions 12 may be formed with, for example, carbon nanotube, graphite, graphite nanofiber, diamond, diamond-like carbon, $C_{60}$, silicon nanowire, or a combination thereof, by way of, for example, screen-printing, direct growth, chemical vapor deposition, or sputtering.

As seen in FIGS. 2 and 3, electron emission regions 12 are formed with a circular shape, and are linearly arranged at the respective unit pixels along the length of the cathode electrodes 6. However, the shape, number per unit pixel, and arrangement of the electron emission regions 12 are not limited to the illustrated, but may be altered in various manners.

A second insulating layer 16 and a focusing electrode 18 are formed on the gate electrodes 10 and the first insulating layer 8. Openings 20 are formed at the second insulating layer 16 and the focusing electrode 18 to allow passage of the electron beams. For instance, the openings 20 may be provided in a one-to-one correspondence at the respective unit pixels. In this case, the focusing electrode collectively focuses the electrons emitted at the one unit pixel.

The focusing electrode 18 may cover substantially the entire area of the first substrate 2. The focusing electrode 18 may be formed as a metallic film coated on the second insulating layer 16, or as a metallic plate with opening portions attached to the second insulating layer 16.

Red, green and blue phosphor layers 22R, 22G and 22B are formed on a surface of the second substrate 4 facing the first substrate 2 while being spaced apart from each other by a particular distance. Black layers 24 are disposed between the respective phosphor layers 22 to enhance the screen contrast.

In this embodiment, an anode electrode 26 is formed on the phosphor layers 22 and the black layers 24 with an aluminum-based metallic material. The anode electrode 26 receives a voltage required to accelerate the electron beams, and reflects the visible rays radiated from the phosphor layers 22, thereby increasing the screen luminance.

Alternatively, the anode electrode 26 may be formed with a transparent conductive material, such as indium tin oxide (ITO). In this case, the anode electrode is placed on a surface of the phosphor layers 22 and the black layers 24 facing the second substrate 4, and may be patterned with a plurality of portions.

Spacers 28 are arranged between the first and the second substrates 2 and 4, and the peripheries of the substrates 2 and 4 are sealed to each other using a sealing member, such as a glass frit. The inner space between the substrates 2 and 4 is exhausted and kept in a vacuum state, thereby forming the display panel 110. The spacers 28 are located at the non-light emission area of the black layers 24.

With the above structure, the cathode electrodes 6 are connected to the data driving unit 130 to receive data driving voltages therefrom, and the gate electrodes 10 are connected to the scan driving unit 140 to receive scan driving voltages therefrom. The focusing electrode 16 receives 0V or a negative (−) direct current (DC) voltage of several to several tens of volts, and the anode electrode 26 receives a positive (+) direct current (DC) voltage of several hundred to several thousand volts.

Figure 4:
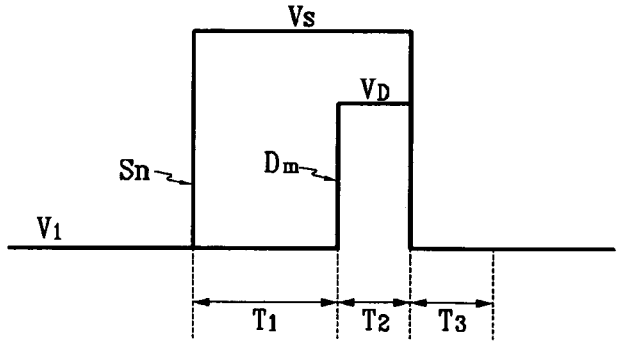
FIG. 4 illustrates driving waveforms applied to cathode and gate electrodes for an electron emission device according to an embodiment of the present invention.

FIG. 4 illustrates the driving waveforms applicable to the electron emission device according to one embodiment of the present invention.

As shown in FIG. 4, an ON voltage $V_S$ of the scan signal is applied to the scan electrode Sn within the period T1, and an ON voltage $V_1$, of the data signal is applied to the data electrode Dm. Then, electrons are emitted from the electron emission regions due to the difference $V_S-V_1$ of the voltages applied to the scan electrode Sn and the data electrode Dm. The emitted electrons collide against the phosphor layers to thereby light-emit them.

Thereafter, the ON voltage $V_S$ of the scan signal is held at the scan electrode Sn within the period T2, and an OFF voltage VD of the data signal is applied to the data electrode Dm. Then, the difference $V_S-V_D$ of the voltages applied to the scan electrode Sn and the data electrode Dm is reduced, and hence, electrons are not emitted from the electron emission regions. The pulse width within the periods T1 and T2 may be varied to thereby express the desired gray scales.

An OFF voltage $V_1$, of the scan signal is applied to the scan electrode Sn within the period T3, and an OFF voltage $V_1$, of the data signal is applied to the data electrode Dm. Therefore, electrons are not emitted from the electron emission regions. The OFF voltage $V_1$ of the scan signal may be established to be the same as the ON voltage $V_1$, of the data signal, such as 0V.

The ON/OFF of the emission current and the amount of emission current are controlled by the combination of the scan and the data pulses. Referring to FIGS. 2–4. the electrons emitted from the electron emission regions 12 are focused at the center of the bundle of electron beams by the focusing voltage while passing the focusing electrode 16, and attracted by the anode voltage. The emitted electrons are accelerated toward the corresponding phosphor layers 22, and collide against the phosphor layers 22. In this process, the focusing electrode 16 and the second insulating layer 14 weaken the influence of the anode electric field with respect to the electron emission regions 12.

The emission current can be controlled by forming electric fields due to the voltage difference between the gate and the cathode electrodes 10 and 6 without interference by external factors (such as an anode electric field) under the application of a predetermined voltage to the anode electrode. In this case, the difference $V_D$ of the OFF voltage of the data signal from the ON voltage $V_S$ of the scan signal, that is, the turn-off voltage, is a factor in determining the driving characteristic of the electron emission device.

In one embodiment, when the ON voltage $V_S$ of the scan signal applied to the gate electrode is indicated by Vg, and the OFF voltage $V_D$ of the data signal applied to the cathode electrode is indicated by Vc, the values of Vg and Vc satisfy the following condition (Formula 1): $0.4 \leqq Vc/Vg < 0.8$.

FIGS. 5 to 10 are graphs illustrating the emission delay characteristic as a function of the variation in Vc/Vg. The horizontal axis of the graph indicates time, and the vertical axis thereof indicates emission current. The emission delay experiments were conducted by measuring the emission current per one minute while realizing a white mode for ten (10) minutes, then a black mode for one (1) minute, and then shifting back into a white mode for the remainder of the experiment.

Figure 5:
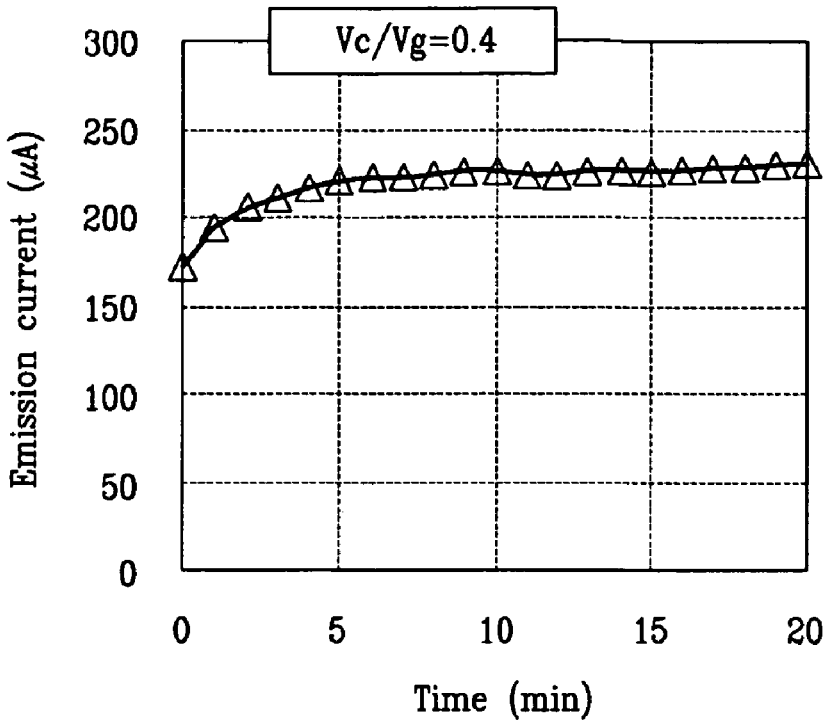
FIG. 5 is a graph illustrating the emission delay characteristics of an electron emission device according to an Example 1.

FIG. 5 illustrates the experimental results obtained according to an Example 1, where Vc/Vg was 0.4. The value of Vg was established to be 50V, and the value of Vc was established to be 20V. As shown, the emission current quickly recovered at the initial shift time point of the second white mode so that the emission delay was not observed.

Figure 6:
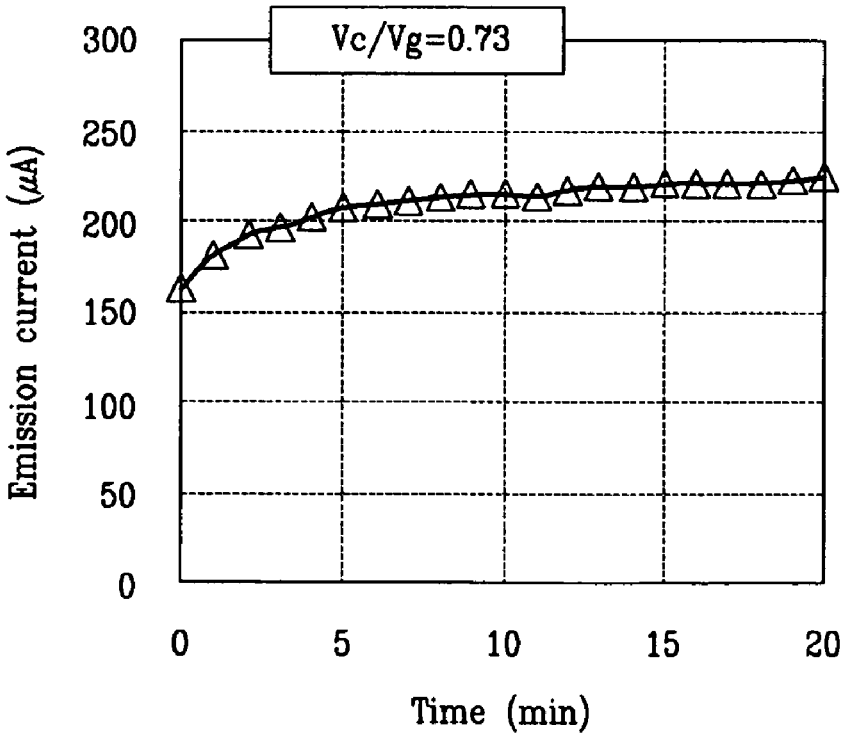
FIG. 6 is a graph illustrating the emission delay characteristics of an electron emission device according to an Example 2.

FIG. 6 illustrates the experimental results obtained in an Example 2, where Vc/Vg was 0.73. The value of Vg was established to be 110V, and the value of Vc to be 80V. As shown in the drawing, the emission current was quickly recovered at the initial shift time point of the second white mode so that an emission delay was not observed.

Figure 7:
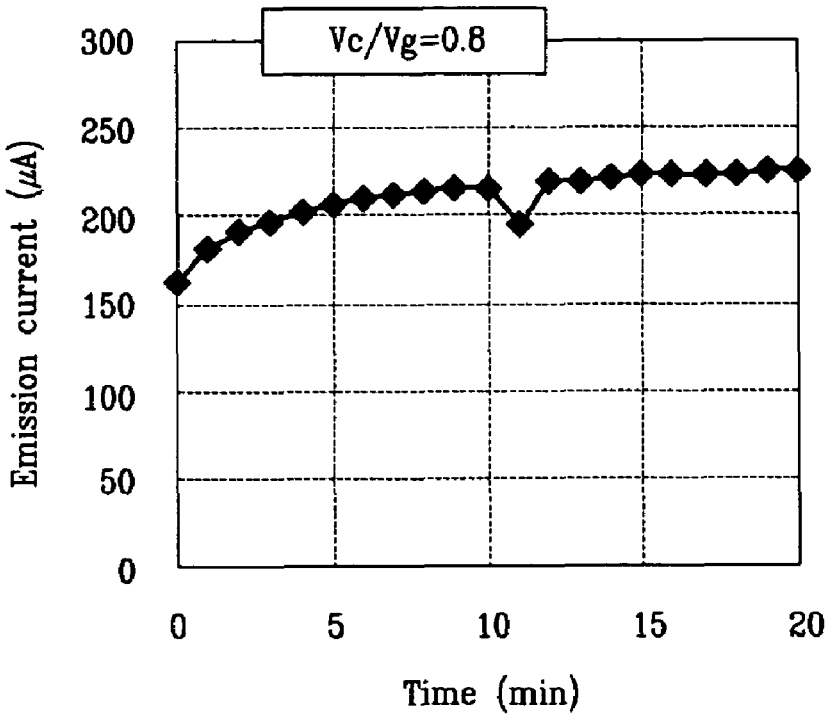
FIG. 7 is a graph illustrating the emission delay characteristics of an electron emission device according to a Comparative Example 1.

FIG. 7 illustrates the experimental results obtained in a Comparative Example 1, where Vc/Vg was 0.8. The value of Vg was established to be 100V, and the value of Vc was established to be 80V. As shown, the emission reduction ratio was approximately 9.3% at the initial shift time point of the second white mode, and the emission delay time was approximately one (1) minute.

The emission reduction ratio is the ratio of the emission current measured at the initial time point of the second white mode to the emission current measured at the final time point of the first white mode. The emission delay time is the time required for the emission current measured at the final time point of the first white mode to be recovered within ±5%. The screen luminance is deteriorated during this emission delay time.

Figure 8:
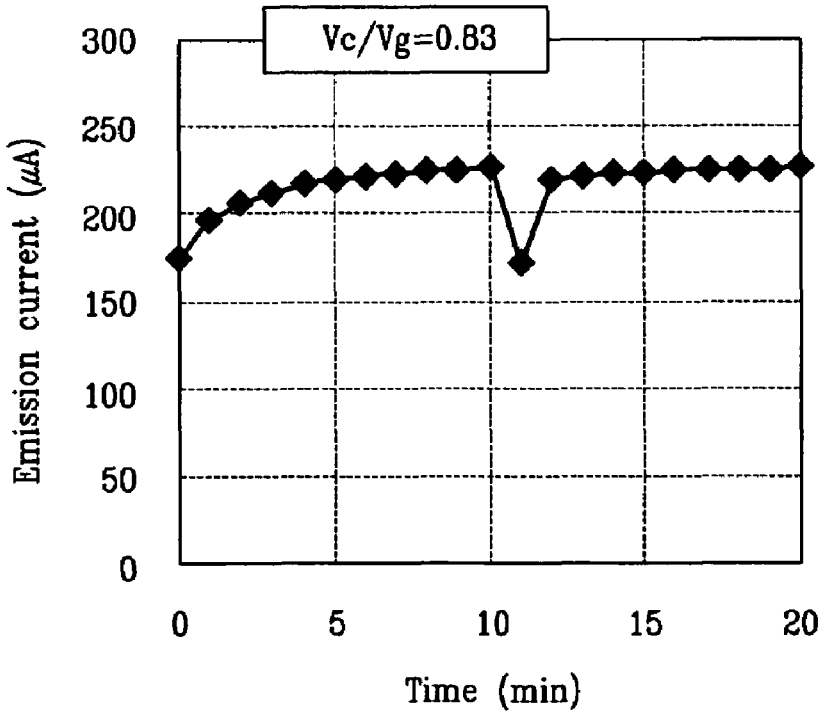
FIG. 8 is a graph illustrating the emission delay characteristics of an electron emission device according to a Comparative Example 2.

FIG. 8 illustrates the experimental results obtained according to a Comparative Example 2, where Vc/Vg was 0.83. The value of Vg was established to be 120V, and the value of Vc was established to be 100V. As shown, the emission reduction ratio was approximately 24.4% at the initial shift time point of the second white mode, and the emission delay time was about one (1) minute.

Figure 9:
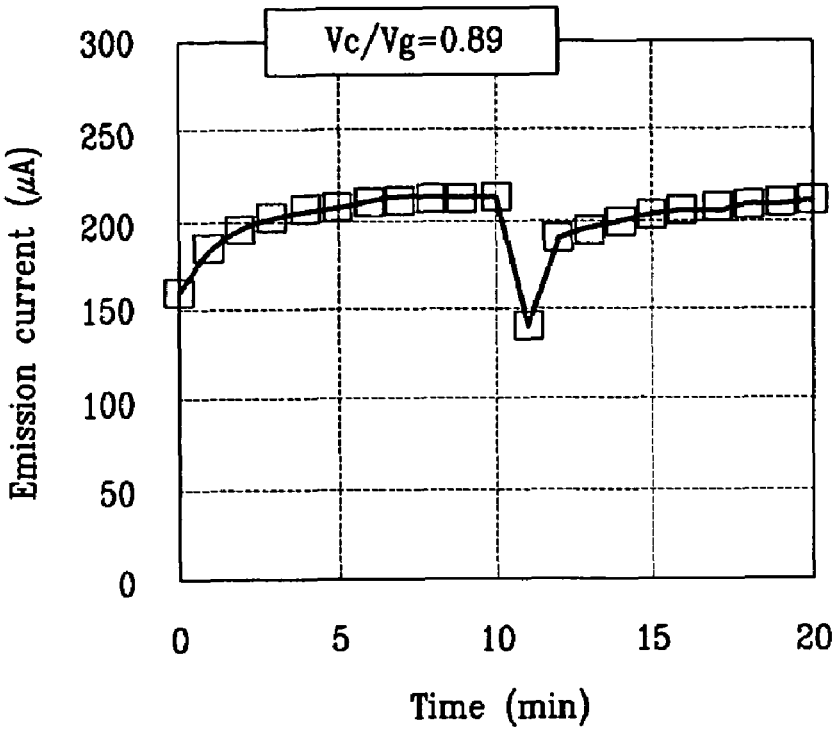
FIG. 9 is a graph illustrating the emission delay characteristics of an electron emission device according to a Comparative Example 3.

FIG. 9 illustrates the experimental results obtained according to a Comparative Example 3, where Vc/Vg was 0.89. The value of Vg was established to be 90V, and the value of Vc was established to be 80V. As shown, the emission reduction ratio was approximately 31% at the initial shift time point of the second white mode, and the emission delay time was approximately four (4) minutes.

Figure 10:
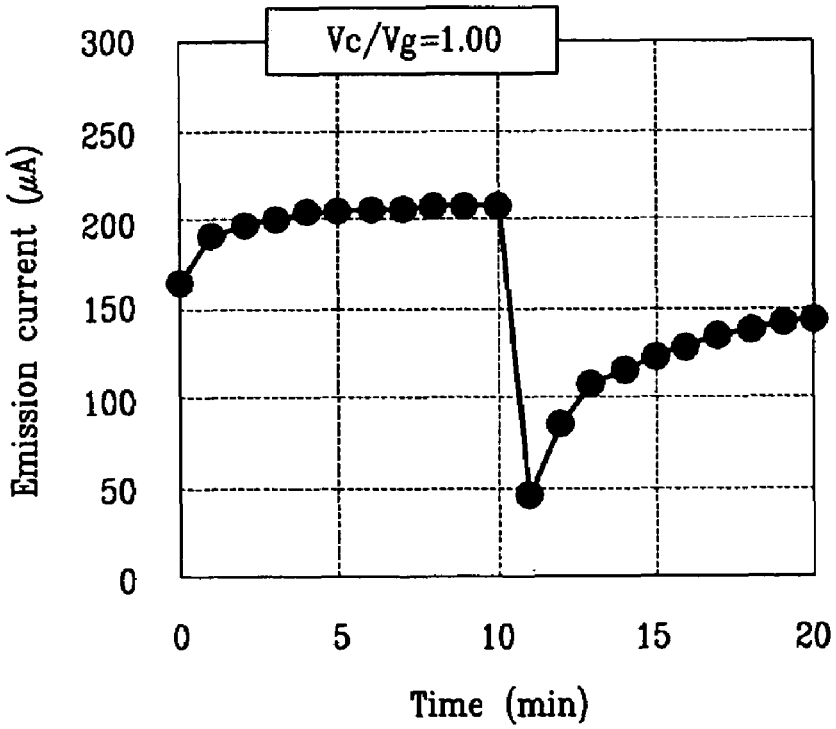
FIG. 10 is a graph illustrating the emission delay characteristics of an electron emission device according to a Comparative Example 4.

FIG. 10 illustrates the experimental results obtained according to a Comparative Example 4, where Vc/Vg was 1. The values of Vg and Vc were both established to be 70V. As shown, the emission reduction ratio was approximately 75.6% at the initial shift time point of the second white mode, and the emission current was not recovered even nine (9) minutes later.

It is estimated that the above-described results are obtained because as the ratio of Vc to Vg increases, the driving signals become distorted and delayed due to the external factors such as a resistance of the cathode and the gate electrodes or a parasitic capacitance between the two electrodes. When the value of Vc/Vg is less than 0.4, the difference between the turn-on voltage ($V_S$–$V_1$ shown in FIG. 4) and the turn-off voltage ($V_S$–$V_D$ shown in FIG. 4) is so slight that the basic data-off operation might not occur.

Establishing the value of Vc/Vg to satisfy the condition of the Formula 1 can thus result in excellent moving image quality as emission delay is limited, even during an image shift inducing a considerably large emission current variation.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims and their equivalents.

What is claimed is:

1. An electron emission device comprising:

cathode electrodes;

gate electrodes formed over the cathode electrodes;

an insulating layer disposed between the cathode electrodes and the gate electrodes;

electron emission regions formed on the cathode electrodes to emit electrons under the application of electric fields generated due to a difference between respective voltages applied to the cathode electrodes and the gate electrodes;

a driving unit for applying the respective voltages to the cathode electrodes and the gate electrodes; and an anode electrode for receiving a positive voltage to accelerate the electrons emitted from the electron emission regions, wherein a first voltage Vc applied to the cathode electrodes and a second voltage Vg applied to the gate electrodes satisfy the following condition:

$0.4 \leqq Vc/Vg < 0.8$.

2. The electron emission device of claim 1, wherein the driving unit applies the first voltage and the second voltage to the respective cathode electrodes and the gate electrodes such that electrons are not emitted from the electron emission regions.

3. The electron emission device of claim 2, wherein the driving unit applies pulses with the first voltage and a third voltage lower than the first voltage to the cathode electrodes while applying the second voltage to the gate electrode, and the amount of electrons emitted from the electron emission regions is determined by a period of time during which the third voltage is applied to the cathode electrodes.

4. The electron emission device of claim 1, further comprising a focusing electrode formed over the gate electrodes to receive 0V or a negative voltage.

5. A method of driving an electron emission device comprising first electrodes, second electrodes insulated from the first electrodes, and electron emission regions formed at any one of the first electrodes and the second electrodes to emit electrons due to a difference between voltages applied to the first electrodes and the second electrodes, the method comprising:

applying a first voltage to the first electrodes; and applying pulses with a second voltage and a third voltage to the second electrodes under the application of the first voltage to the first electrodes;

wherein the first voltage and the second voltage satisfy the condition of $0.4 \leqq Vc/Vg < 0.8$, where Vc indicates a lower one of the first voltage and the second voltage, and Vg indicates a higher one of the first voltage and the second voltage.

6. The method of claim 5, wherein when the third voltage is applied to the second electrodes, electrons are emitted from the electron emission regions.

7. The method of claim 6, wherein the electron emission regions are formed on the second electrodes, Vc is the second voltage, and Vg is the first voltage.

8. The method of claim 5, wherein an amount of electrons emitted from said electron emission regions is determined by a period of time during which the third voltage is applied.

9. An electron emission display device comprising:

cathode electrodes;

gate electrodes formed over the cathode electrodes;

an insulating layer disposed between the cathode electrodes and the gate electrodes;

electron emission regions formed on the cathode electrodes to emit electrons under the application of electric fields generated due to a difference between respective voltages applied to the cathode electrodes and the gate electrodes;

a driving unit for applying the respective voltages to the cathode electrodes and the gate electrodes;

an anode electrode for receiving a positive voltage to accelerate the electrons emitted from the electron emission regions; and phosphor layers on the anode electrode, wherein a first voltage Vc applied to the cathode electrodes and a second voltage Vg applied to the gate electrodes satisfy the following condition:

$0.4 \leqq Vc/Vg < 0.8$.

10. The electron emission display device of claim 9, wherein the driving unit applies the first voltage and the second voltage to the respective cathode electrodes and the gate electrodes such that electrons are not emitted from the electron emission regions.

11. The electron emission display device of claim 10, wherein the driving unit applies pulses with the first voltage and a third voltage lower than the first voltage to the cathode electrodes while applying the second voltage to the gate electrode, and the amount of electrons emitted from the electron emission regions is determined by a period of time during which the third voltage is applied to the cathode electrodes.

12. The electron emission display device of claim 9, further comprising a focusing electrode formed over the gate electrodes to receive 0V or a negative voltage.

13. The electron emission display device of claim 9, further comprising a black layers disposed between the phosphor layers.

* * * * *

UNITED STATES PATENT AND TRADEMARK OFFICE

CERTIFICATE OF CORRECTION

PATENT NO. : 7,221,099 B2
APPLICATION NO. : 11/351632
DATED : May 22, 2007
INVENTOR(S) : Jeon et al.

It is certified that error appears in the above-identified patent and that said Letters Patent is hereby corrected as shown below:

On the Title Page

| | |
|---|---|
| Item (73) Assignee | Delete "Samsung ASDI"<br>Insert --Samsung SDI-- |

In the Claims

| | |
|---|---|
| Column 8, line 56, Claim 13 | Delete "a" |

Signed and Sealed this

Fourth Day of December, 2007

JON W. DUDAS
*Director of the United States Patent and Trademark Office*